US005104093A

United States Patent [19]

Katchka et al.

[11] Patent Number: 5,104,093

[45] Date of Patent: Apr. 14, 1992

[54] FUEL CONTROL DEVICE, VALVE MEMBER THEREFOR AND METHODS OF MAKING THE SAME

[75] Inventors: Jay R. Katchka, Cypress; Samuel T. Kelly, Torrence, both of Calif.

[73] Assignee: Robertshaw Controls Company, Richmond, Va.

[21] Appl. No.: 661,844

[22] Filed: Feb. 27, 1991

[51] Int. Cl.[5] ..... F16K 31/00

[52] U.S. Cl. ..... 251/358; 251/357

[58] Field of Search ..... 251/357, 356, 358

[56] References Cited

U.S. PATENT DOCUMENTS 2,920,861 1/1960 Hartmann ..... 251/357
3,310,277 3/1967 Nielsen et al. ..... 251/368
3,626,481 12/1971 Rattan ..... 251/356
4,475,711 10/1984 Rountry ..... 251/358

FOREIGN PATENT DOCUMENTS 0092482 10/1983 European Pat. Off. ..... 251/358

*Primary Examiner*—A. Michael Chambers
*Attorney, Agent, or Firm*—Candor, Candor & Tassone

[57] ABSTRACT

A fuel control device, valve member therefor and methods of making the same are provided, the valve member comprising a rigid tubular part carrying a resilient polymeric part and having opposed ends one of which has an opening therethrough for receiving part of a guide stem therein for guiding purposes, the polymeric part having opposed sides one of which has an opening therein that snap-fittingly receives the other end of said opposed ends of the tubular part therein to interconnect the polymeric part and the tubular part together.

14 Claims, 2 Drawing Sheets

FUEL CONTROL DEVICE, VALVE MEMBER THEREFOR AND METHODS OF MAKING THE SAME

BACKGROUND OF THE INVENTION

1. Field of the Invention

This invention relates to a new fuel control device and to a new valve member therefor as well as to new methods of making such a fuel control device and such a valve member.

2. Prior Art Statement

It is known to provide a fuel control device comprising a housing means having an inlet means and an outlet means and having a valve seat means interconnecting the inlet means and the outlet means together, a movable valve member carried by the housing means for opening and closing the valve seat means, and a guide stem carried by the housing means to guide axial movement of the valve member relative to the valve seat, the valve member comprising a resilient polymeric part for engaging the valve seat means to seal closed the same when the valve member is in the closed position thereof, the valve member comprising a rigid tubular part carrying the polymeric part and having opposed ends one of which has an opening therethrough and receives part of the stem therein for guiding purposes. For example, see the U.S. Pat. No. 4,928,721 to Kelly et al, and the U.S. Pat. No. 4,549,571 to Kelly.

SUMMARY OF THE INVENTION

It is one feature of this invention to provide a new valve member for a fuel control device or the like wherein the valve member has the parts thereof adapted to be assembled together in a relatively simple manner with the resulting valve member being readily effective to perform its valve closing and opening function.

In particular, it was found according to the teachings of this invention that the rigid tubular part and the resilient polymeric part of the valve member can be uniquely formed so that the same can be snap-fittingly interconnected together during the subsequent assembly thereof.

For example, one embodiment of this invention comprises a fuel control device comprising a housing means having an inlet means and outlet means and having a valve seat means interconnecting the inlet means and the outlet means together, a movable valve member carried by the housing means for opening and closing the valve seat means, and a guide stem carried by the housing means to guide axial movement of the valve member relative to the valve seat, the valve member comprising a resilient polymeric part for engaging the valve seat means to seal closed the same when the valve member is in the closed condition thereof, the valve member comprising a rigid tubular part carrying the polymeric part and having opposed ends one of which has an opening means therethrough and receives part of the stem therein for guiding purposes, the polymeric part having opposed sides one of which has an opening therein that snap-fittingly receives the other end of the opposed ends of the tubular part therein to interconnect the polymeric part and the tubular part together.

Accordingly, it is an object of this invention to provide a new fuel control device having one or more of the novel features of this invention as set forth above or hereinafter shown or described.

Another object of this invention is to provide a new method of making such a fuel control device, the method of this invention having one or more of the novel features of this invention as set forth above or hereinafter shown or described.

Another object of this invention is to provide a new valve member for a fuel control device or the like, the valve member of this invention having one or more of the novel features of this invention as set forth above or hereinafter shown or described.

Another object of this invention is to provide a new method of making such a valve member, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
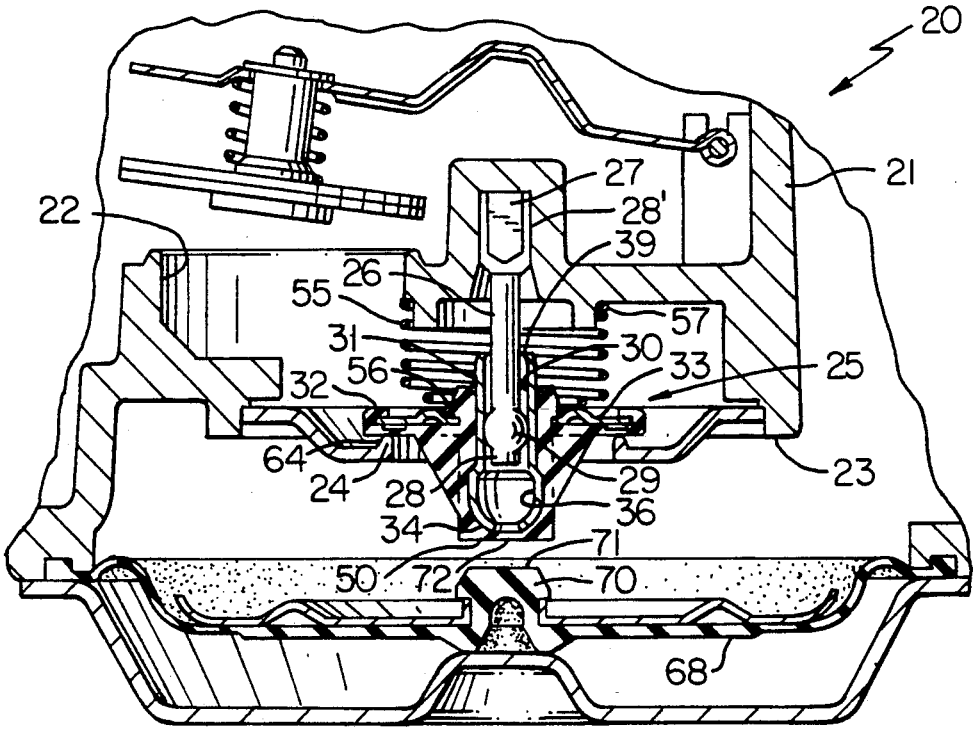
FIG. 1 is a fragmentary cross-sectional view illustrating the new fuel control device of this invention, the valve member of this invention being disposed in its closed condition.

While the various features of this invention are hereinafter illustrated and described as being particularly adapted to provide a valve member for a fuel control device, it is to be understood that the various features of this invention can be utilized singly or in various combinations thereof to provide a valve member to be utilzied with other types of devices as desired.

Therefore, this invention is not to be limited to only the embodiment illustrated in the drawings, because the drawings are merely utilized to illustrate one of the wide variety of uses of this invention.

Figure 2:
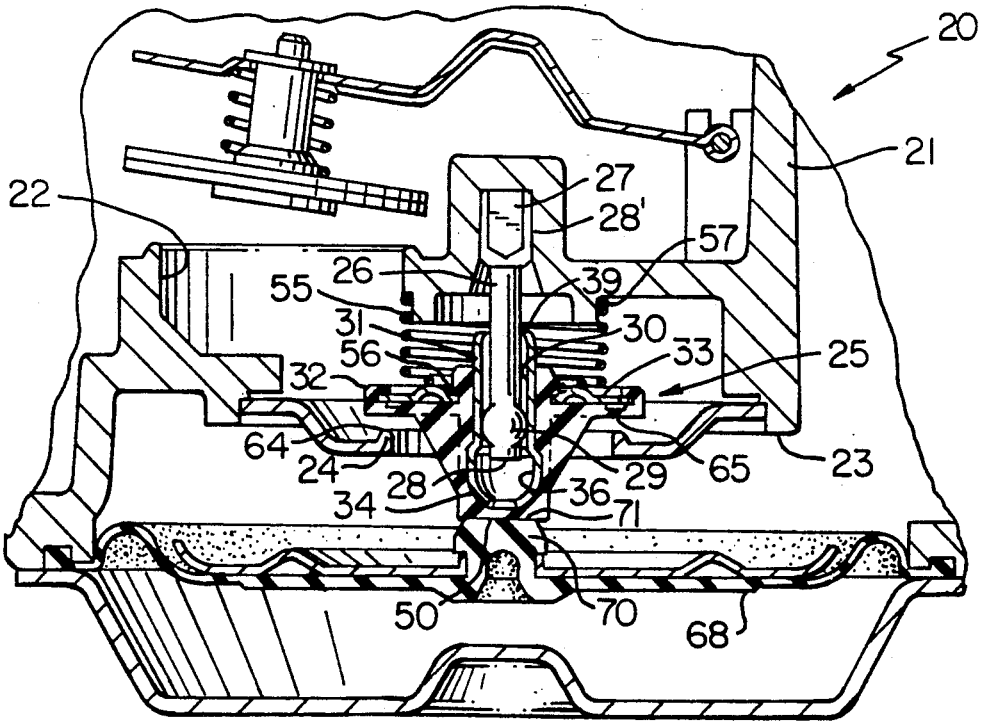
FIG. 2 is a view similar to FIG. 1 and illustrates the valve member in an open condition thereof.
Figure 3:
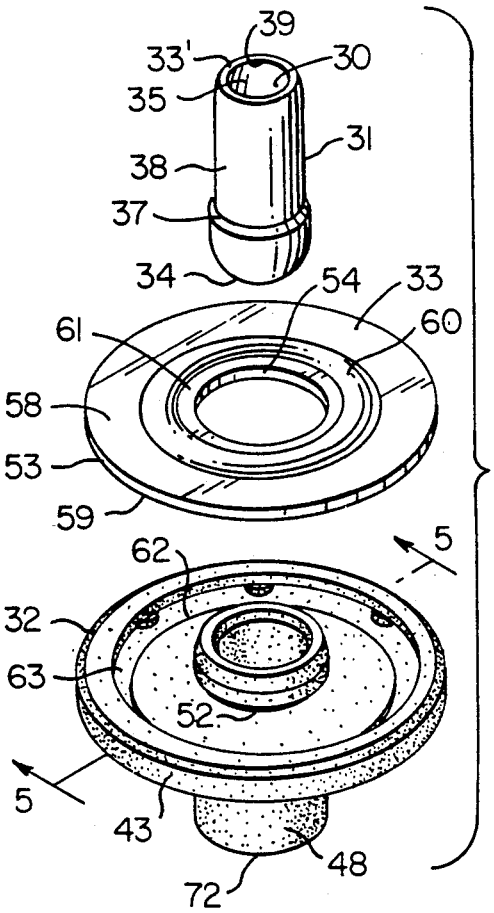
FIG. 3 is an exploded perspective view of the three parts that form the valve member of this invention for the control device of FIGS. 1 and 2.

Referring now to FIGS. 1 and 2, the new fuel control device of this invention is generally indicated by the reference numeral 20 and comprises a housing means 21 having an inlet means 22 and an outlet means 23 separated from each other by a valve seat means 24 that is adapted to be opened and closed by a valve member of this invention that is generally indicated by the reference numeral 25, the control device 20 being of the type fully disclosed and claimed in the aforementioned U.S. Pat. No. 4,928,721 to Kelly et al, whereby this U.S. patent is being incorporated into this disclosure by this reference thereto.

Therefore, since the details of the control device 20 are now well known in the art, only the details of the control device 20 necessary to understand the features of this invention will be hereinafter set forth.

The housing means 21 carries a guide stem 26 for guiding axial movement of the valve member 25 relative to the valve seat 24, such guide stem 26 being of the type that is fully set forth in the aforementioned U.S. Pat. No. 4,928,721 to Kelly et al, as well as in the aforementioned U.S. Pat. No. 4,549,571 to Kelly et al, whereby this U.S. Pat. No. 4,549,571 to Kelly, is also being incorporated into this disclosure by this reference thereto.

The guide stem 26 can be formed of any suitable rigid material, such as metallic material, and has opposed ends 27 and 28, the end 27 being fixed in an opening 28 in the housing means 21 in any suitable manner while the free end 28' is provided with a spherical projection 29 that is received in a cylindrical section 30 of a rigid tubular member 31 that forms part of the valve member 28 in a manner hereinafter described whereby the ball-like projection 29 of the stem 26 guides axial movement of the valve member 25 in a universal-like manner relative to the valve seat 24 as will be apparent hereinafter.

The valve member 25 of this invention is formed of the rigid tubular part 31, a resilient polymeric part 32 and a rigid backup washer-like plate 33 by the method of this invention in a manner hereinafter set forth whereby the valve member 25 comprises a three-part structure.

The rigid tubular member 31 has opposed ends 33' and 34 with an opening 35 formed through the ends 33' and 34 thereof and defining an enlarged cavity 36 in the end 34 so that the end 34 itself is enlarged and defines an annular external shoulder means 37 that extends radially outwardly from a generally cylindrical portion 38 thereof that has the cylindrical section 30 therein. The end 33' of the rigid tubular member 31 is slightly turned inwardly at the inner edge 39 thereof so that the ball projection 29 of the guide stem 26 must be snap-fitted through the edge 39 when being received in the cylindrical portion 30 of the opening 35 in the manner illustrated in FIGS. 1 and 2 so that once the tubular member 31 has been assembled onto the guide stem 26, the valve member 25 will not fall off of the same during subsequent assembly of the control device 20. Of course, for disassembly purposes, the valve member 25 can be unsnapped from the ball projection 29 by pulling outwardly on the valve member 25 relative to the guide stem 26.

The resilient polymeric part 32 of the valve member 25 is a one-piece member that has been molded from any suitable polymeric material, such as rubber, and having a central column-like section 40 provided with opposed ends 41 and 42 and a disc-like section 43 integrally joined to the column-like section 40 and being disposed intermediate the opposed ends 41 and 42 thereof, the disc-like section 43 having opposed sides 44 and 45.

An opening 46 is formed through the end 41 of the column-like section 40 of the resilient polymeric part 32 and is stepped in a manner to define a substantially cylindrical section 47 and an enlarged cavity 48 adjacent the end 42 whereby an internal annular shoulder 49 is created between the section 47 and the cavity 48 that faces toward the closed end 50 of the opening 46 as illustrated, the opening 46 and the rigid tubular part 31 being so constructed and arranged that when the tubular part 31 is disposed down into the opening 46 of the resilient polymeric part 32, the enlarged end 34 of the rigid tubular part 31 has its annular shoulder 37 snapped beyond the shoulder 49 of the resilient polymeric part 32 so as to be engaged by such annular shoulder 49 in the manner illustrated in FIGS. 1 and 2 whereby the rigid tubular part 31 is snap-fittingly interconnected to the resilient polymeric part 32 so as to be carried thereby in a self-contained arrangement without requiring any other fastening means.

The resilient polymeric part 32 of the valve member 25 has an annular groove 51 formed in the disc-like section 43 and an annular groove 52 formed in the column-like section 40, the annular grooves 51 and 52 being in spaced apart aligned relation and facing each other so as to be adapted to respectively receive an outer peripheral edge means 53 and inner peripheral edge means 54 of the rigid backup plate 33 therein in a snap-fit manner so that the backup plate means 33 is carried by the resilient polymeric part 32 in the manner illustrated in FIGS. 1 and 2 without requiring any other fastening means.

In this manner, a suitable compression spring 55 is adapted to have one end 56 thereof bear against the rigid backup plate 33 and the other end 57 thereof bear against the housing means 21 so as to tend to always move the valve member 25 in a direction to close the valve seat means 24 by forcing the side 45 of the disc-like section 43 of the valve member 25 into sealing relation with the valve seat means 24 in the manner illustrated in FIG. 1.

The rigid backup plate 33 can be formed of any suitable material, such as metallic material, and has opposed sides 58 and 59, the plate 33 having an annular projection 60 formed outwardly from the side 58 thereof adjacent the inner peripheral edge means 54 to define a flat annular portion 61 against which the end 56 of the compression spring 55 engages in the manner illustrated in FIG. 2. In this manner, the end 56 of the compression spring 55 is confined between the column-like section 40 of the resilient polymeric part 32 of the valve member 25 and the annular projection 60 on the backup plate 33 as illustrated in FIGS. 1 and 2.

In order to add flexibility to the side 45 of the resilient polymeric part 32 in its sealing relationship with the valve seat means 24, an annular recess 62 is formed in the side 44 of the disc-like section 43 of the resilient polymeric part 32, such recess 62 defining an annular surface 63 that is spaced from the side 59 of the backup plate 33 in the manner illustrated in FIGS. 1 and 2 to permit an annular projection 64 on the valve seat means 24 to compress into an annular section 65 of the disc-like section 43 of the resilient polymeric part 32 when the valve member 25 is forced against the valve seat means 24 by the compression spring 55 in the manner illustrated in FIG. 1. In order to make sure that the outer peripheral edge means 53 of the backup plate 33 is raised above the annular surface 63 of the disc-like section 43 of the resilient polymeric part 32 of the valve member 25, a plurality of raised abutments 66 are formed by the recess means 62 in spaced apart circular relation so as to engage against the side 59 of the backup plate 33 adjacent the outer peripheral edge 53 thereof as illustrated.

Figure 4:
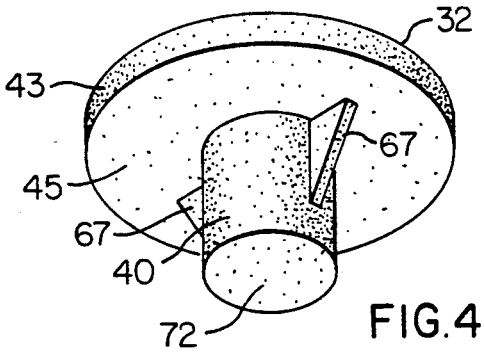
FIG. 4 is a bottom perspective view of the resilient polymeric part of the valve member of this invention.
Figure 6:
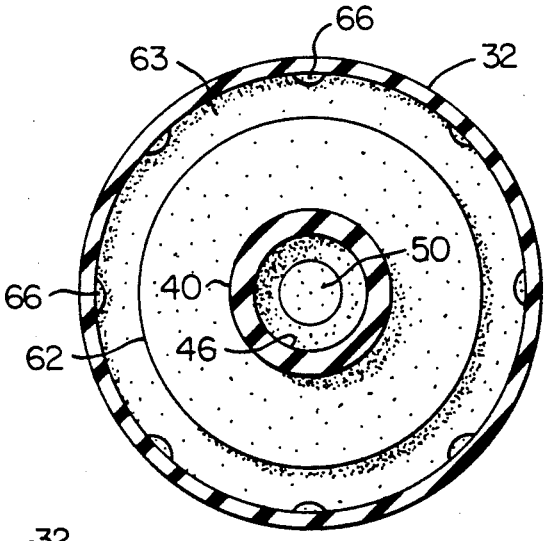
FIG. 6 is a cross-sectional view taken on line 6—6 of FIG. 5.
Figure 5:
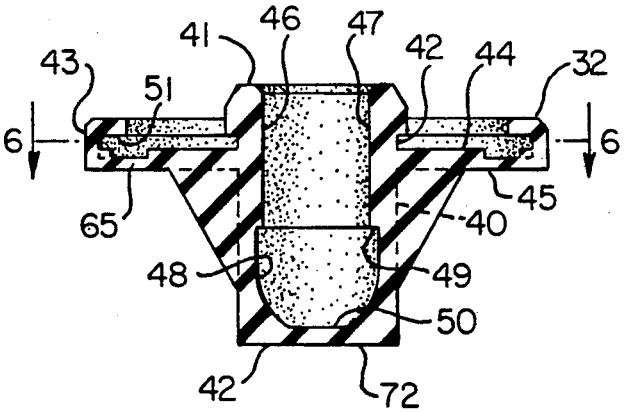
FIG. 5 is a cross-sectional view taken on line 5—5 of FIG. 3 and illustrates the resilient polymeric part of this invention.

A plurality of reinforcing ribs 67 are formed on the column-like section 40 and join with the side 45 of the disc-like section 43 in the manner illustrated in FIGS. 4 and 5 so as to reinforce the interconnection of the disc-like section 43 with the column-like section 40 of the resilient polymeric part 32.

The control device 20 is adapted to move the valve member 25 from its closed condition of FIG. 1 to its open position of FIG. 2. In particular, the control device 20 has a flexible diaphragm 68 carried by the housing means 21 so that the same cooperates therewith to define a chamber 69 that is adapted to be pressurized in the manner fully set forth in the aforementioned U.S. patents so that a central abutment 70 of the diaphragm 68 is adapted to have a flat surface 71 thereof engaged against a flat end surface 72 of the end 42 of the valve member 25 in the manner illustrated in FIG. 2 and move the valve member 25 vertically upwardly to thereby open the valve seat means 24 in opposition to the force of the compression spring 55, such upward movement of the valve member 25 being guided by the guide stem 26 in the manner illustrated. However, the opening movement of the valve member 25 does not cause the ball part 29 of the guide stem 26 to enter into the enlarged cavity 36 of the tubular part 31 whereby the ball-like part 29 only operates in the cylindrical part 30 of the tubular member 31 as illustrated. When the chamber 69 is subsequently vented to atmosphere, the force of the compression spring 55 returns the valve member 25 to its closed condition against the valve seat means 24 in the manner illustrated in FIG. 1.

Therefore, it can be seen that it is a relatively simple method of this invention to form the three parts 31, 32 and 33 of the valve member 25 of this invention and then assemble the same together by a unique snap-fit arrangement of the rigid tubular part 31 into the opening 35 of the resilient polymeric part 32 in the manner previously set forth and to snap-fit the backup plate 33 into the annular recesses 51 and 52 of the resilient polymeric part 32 so that the valve member 25 is a self-contained unit that is adapted to be assembled onto the guide stem 26 by having the ball part 29 thereof inserted into the opening 35 of the tubular part 31 and have the compression spring 55 bear against the plate-like part 33 to tend to move the valve member 25 to its closed condition against the valve seat 24. Thus, the valve member 25 of this invention is adapted to be readily assembled to the housing means 21 of the control device 20 in a simple and effective manner to control the valve seat means 24 thereof in the manner previously set forth.

Therefore, this invention not only provides a new fuel control device and a new valve member therefor, but also this invention provides a new method of making such a fuel control device and a new method of making such a valve member.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a fuel control device comprising a housing means having an inlet means and an outlet means and having a valve seat means interconnecting said inlet means and said outlet means together, a movable valve member carried by said housing means for opening and closing said valve seat means, and a guide stem carried by said housing means to guide axial movement of said valve member relative to said valve seat means, said valve member comprising a resilient polymeric part for engaging said valve seat means to seal close the same when said valve member is in the closed position thereof, said valve member comprising a rigid tubular part carrying said polymeric part and having opposed ends one of which has an opening therethrough and receives part of said stem therein for guiding purposes, the improvement wherein said polymeric part has opposed ends one of which has an opening therein that snap-fittingly receives the other end of said opposed ends of said tubular part therein to interconnect said polymeric part and said tubular part together, said polymeric part having a central column-like section provided with said opening of said polymeric part therein, said polymeric part having an annular disc-like section carried by said column-like section for engaging said valve seat means, said disc-like section of said polymeric part having opposed sides, said column-like section of said polymeric part having opposed ends respectively disposed outboard of said opposed sides of said disc-like section and comprising said opposed ends of said polymeric part.

2. A fuel control device as set forth in claim 1 wherein said opening of said polymeric part defines an internal shoulder means in said column-like section of said polymeric part, said other end of said tubular part being enlarged so as to define an external shoulder means that snaps beyond said internal shoulder means and engages the same to snap-fittingly interconnect said polymeric part to said tubular part.

3. A fuel control device as set forth in claim 2 wherein said other end of said opposed ends of said polymeric part is a closed end, said opening of said polymeric part having a closed end in said polymeric part adjacent said closed end of said polymeric part, said closed end of said opening of said polymeric part defining an enlarged cavity extending from said internal shoulder means thereof.

4. A fuel control device as set forth in claim 1 wherein said valve member comprises a rigid backup member carried by said disc-like section of said polymeric part.

5. A fuel control device as set forth in claim 4 wherein said backup member comprises a washer-like member.

6. A fuel control device as set forth in claim 5 wherein said washer-like member has an outer peripheral edge means and an inner peripheral edge means, said disc-like section of said polymeric part having a pair of facing annular recess means therein respectively receiving said peripheral edge means of said washer-like member therein whereby said washer-like member is carried by said disc-like section of said polymeric part.

7. A fuel control device as set forth in claim 1 wherein said polymeric part has reinforcing ribs radiating from said column-like section at one end of said opposed ends thereof and respectively joining with one side of said opposed sides of said disc-like section of said polymeric part.

8. In a valve member for a fuel control device comprising a housing means having an inlet means and an outlet means and having a valve seat means interconnecting said inlet means and said outlet means together, said valve member being adapted to be carried by said housing means for opening and closing said valve seat means, and a guide stem carried by said housing means to guide axial movement of said valve member relative to said valve seat means, said valve member comprising a resilient polymeric part for engaging said valve seat means to seal close the same when said valve member is in the closed position thereof, said valve member comprising a rigid tubular part carrying said polymeric part and having opposed ends one of which has an opening therethrough for receiving part of said stem therein for guiding purposes, the improvement wherein said polymeric part has opposed ends one of which has an opening therein that snap-fittingly receives the other end of said opposed ends of said tubular part therein to interconnect said polymeric part and said tubular part together, said polymeric part having a central column-like section provided with said opening of said polymeric part therein, said polymeric part having an annular disc-like section carried by said column-like section for engaging said valve seat means, said disc-like section of said polymeric part having opposed sides, said column-like section of said polymeric part having opposed ends respectively disposed outboard of said opposed sides of said disc-like section and comprising said opposed ends of said polymeric part.

9. A valve member as set forth in claim 8 wherein said opening of said polymeric part defines an internal shoulder means in said column-like section of said polymeric part, said other end of said tubular part being enlarged so as to define an external shoulder means that snaps beyond said internal shoulder means and engages the same to snap-fittingly interconnect said polymeric part of said tubular part.

10. A valve member as set forth in claim 9 wherein said the other end of said opposed ends of said polymeric part is a closed end, said opening of said polymeric part having a closed end in said polymeric part adjacent said closed end of said polymeric part, said closed end of said opening of said polymeric part defining an enlarged cavity extending from said internal shoulder means thereof.

11. A valve member as set forth in claim 8 wherein said valve member comprises a rigid backup member carried by said disc-like section of said polymeric part.

12. A valve member as set forth in claim 13 wherein said backup member comprises a washer-like member.

13. A valve member as set forth in claim 12 wherein said washer-like member has an outer peripheral edge means and an inner peripheral edge means, said disc-like section of said polymeric part having a pair of facing annular recess means therein respectively receiving said peripheral edge means of said washer-like member therein whereby said washer-like member is carried by said disc-like section of said polymeric part.

14. A valve member as set forth in claim 8 wherein said polymeric part has reinforcing ribs radiating from said column-like section at one end of said opposed ends thereof and respectively joining with one side of said opposed sides of said disc-like section of said polymeric part.

* * * * *